US006109197A

United States Patent [19]

Breivik et al.

[11] Patent Number: 6,109,197

[45] Date of Patent: Aug. 29, 2000

[54] SYSTEM FOR LOADING SHIPS AT SEA

[75] Inventors: Kåre Breivik, Tau; Arne Smedal, Færvik; Kåre Syvertsen, Arendal, all of Norway

[73] Assignee: Den Norske Stats Oljeselskap A.S., Stavanger, Norway

[21] Appl. No.: 09/125,360

[22] PCT Filed: Aug. 7, 1996

[86] PCT No.: PCT/NO96/00202

§ 371 Date: Dec. 7, 1998

§ 102(e) Date: Dec. 7, 1998

[87] PCT Pub. No.: WO97/30888

PCT Pub. Date: Aug. 28, 1997

[30] Foreign Application Priority Data

Feb. 21, 1996 [NO] Norway ..... 960698

[51] Int. Cl.[7] ..... B63B 21/00

[52] U.S. Cl. ..... 114/230.2; 114/230.26; 441/5

[58] Field of Search ..... 441/3, 4, 5; 114/293, 114/294, 296, 230.1, 230.2, 230.26

[56] References Cited

U.S. PATENT DOCUMENTS

| | | | |
|---|---|---|---|
| 3,430,597 | 3/1969 | Zunderdorp | 114/230 |
| 3,455,270 | 7/1969 | Mascenik et al. | 114/230 |
| 3,670,686 | 6/1972 | Reynolds | 114/230 |
| 4,081,872 | 4/1978 | Pedersen et al. | 441/5 |
| 4,820,217 | 4/1989 | Joubert et al. | 441/5 |

FOREIGN PATENT DOCUMENTS

| | | |
|---|---|---|
| 2 183 581 | 6/1987 | United Kingdom . |
| WO 93/24731 | 12/1993 | WIPO . |

*Primary Examiner*—Stephen Avila

*Attorney, Agent, or Firm*—Foley & Lardner

[57] ABSTRACT

This invention relates to a system for loading or unloading a ship at sea, in particular for operations in connection with oil and gas activity, whereby the ship concerned is equipped with a mooring device at its bow. There is included an anchor device located at the seabed, and at least one anchoring line adapted to connect the anchor device to the mooring device on the ship. A permanent anchor device is provided with a swivel device for the anchoring line, and a buoyant body is attached to a middle portion of the anchoring line. Moreover, there is provided a hose connected to the swivel device and to the ship, for loading or unloading operations.

19 Claims, 7 Drawing Sheets

SYSTEM FOR LOADING SHIPS AT SEA

This invention relates to a system for loading or unloading ships at sea, in particular for operations in connection with oil and gas activity, whereby the ships concerned are equipped with mooring means at their bow part, and where there is included anchor means located at the seabed, as well as at least one achoring line adapted to connect the anchor means to the mooring means on the ship.

In offshore oil and gas activity there is often the question of very important operations that can be difficult under certain conditions, and whereby there is usually involved transfer of fluids either between a pipeline connected to the anchor means at the seabed and a moored ship. Under varying and difficult conditions, whereby wind, waves and ocean current have influence, great stresses and forces can occur during such mooring and carrying out of these operations. Such stresses in the first place can lead to interruption of the operations and in the worst case can lead to wrecking and e.g. uncontrolled oil discharge. The invention is primarily directed to loading operations, but quite correspondingly may also be utilized for unloading operations, as will be realized straightforwardly by people skilled in the art.

On the background of mooring, loading and unloading systems being known for corresponding purposes, this invention involves novel and specific features as stated more closely in the claims.

Among the advantages obtained by means of the invention, it is emphasized in particular that the challenging operations mentioned, can be carried out under difficult conditions with higher security and reliability in most situations, compared to previously known methods and systems. In this connection it is to be noted in particular that the system according to the invention makes possible a type of elasticity or flexibility in the mooring and the fluid transfer, that involves adaptation of the whole system according to the stresses and forces occurring during the operations to be performed.

Figure 1:
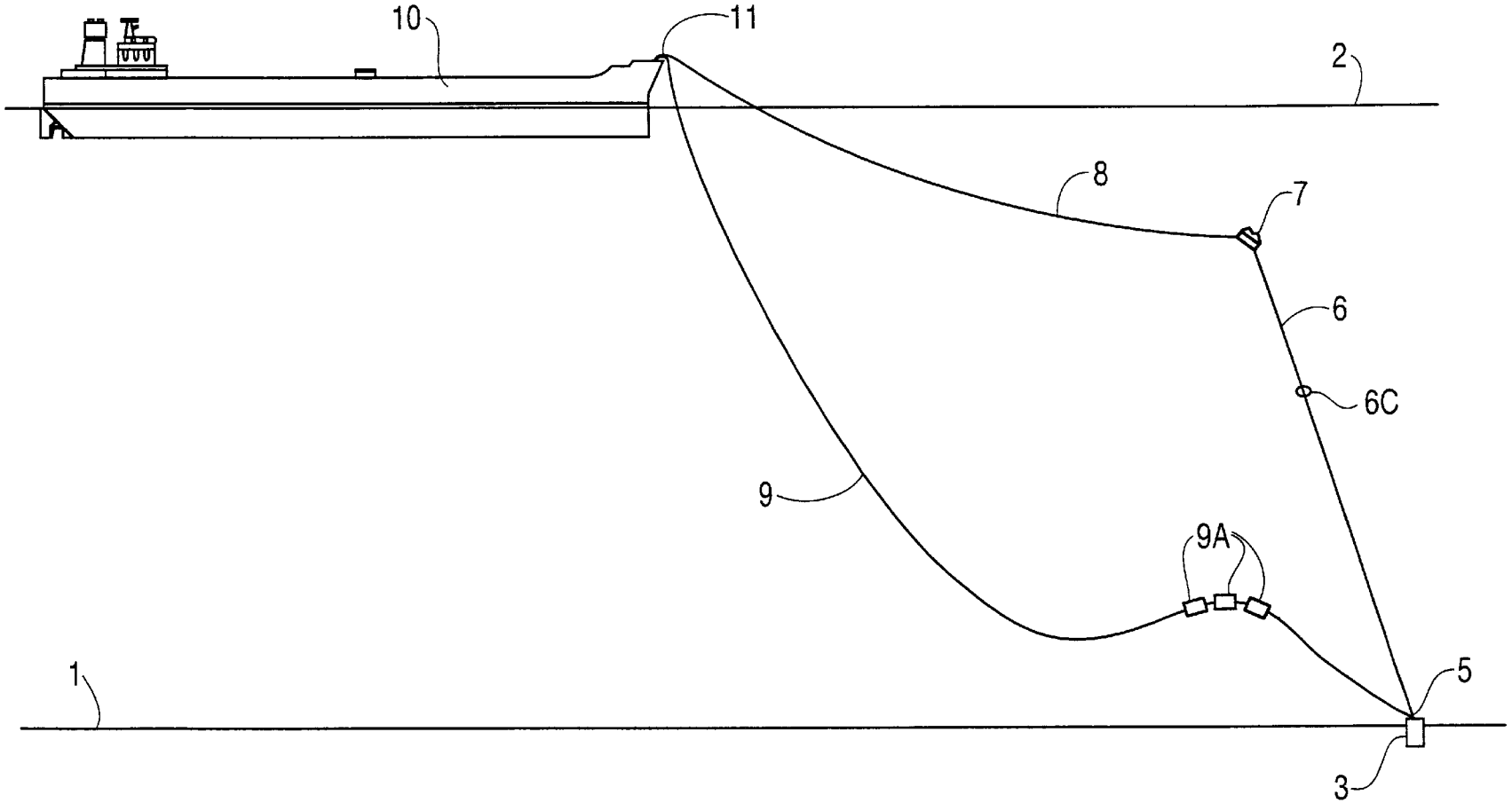
Figure 3:
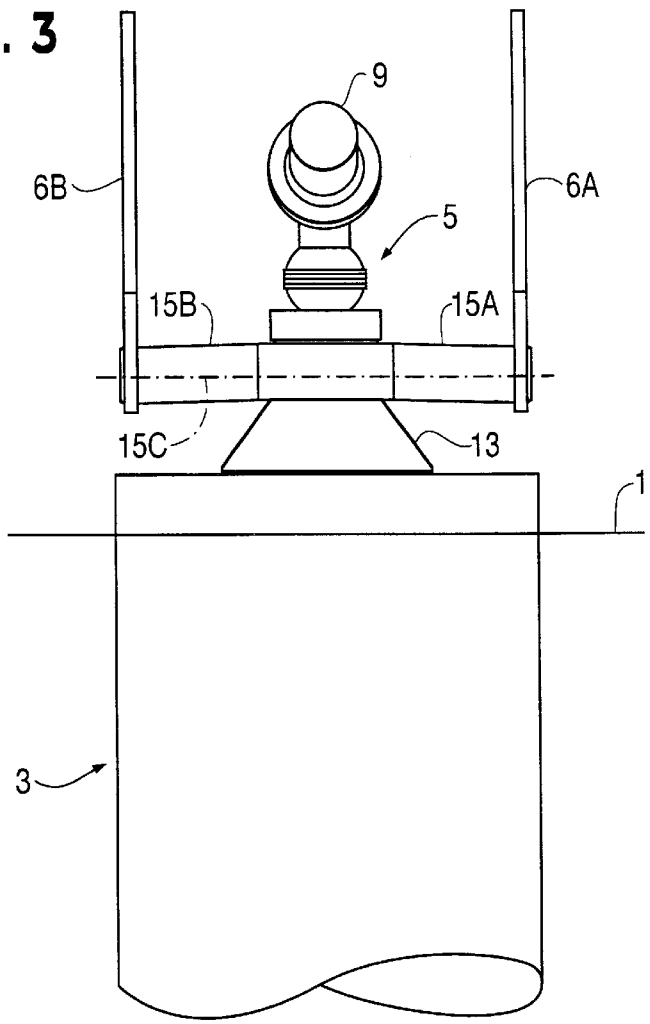
Figure 2:
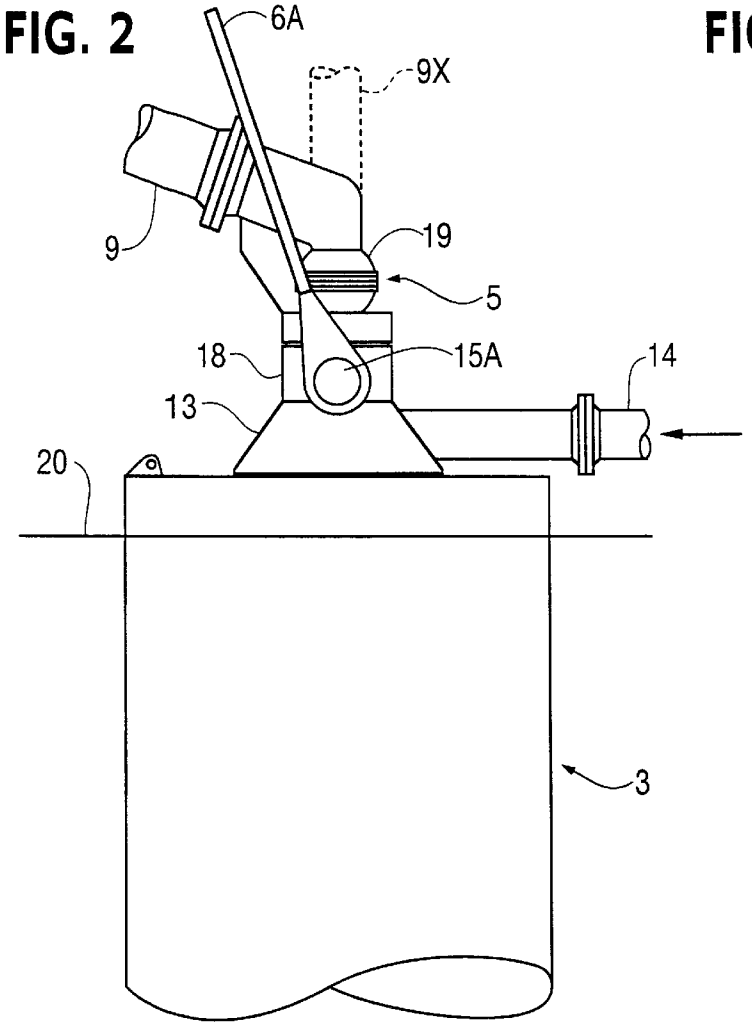
Figure 4:
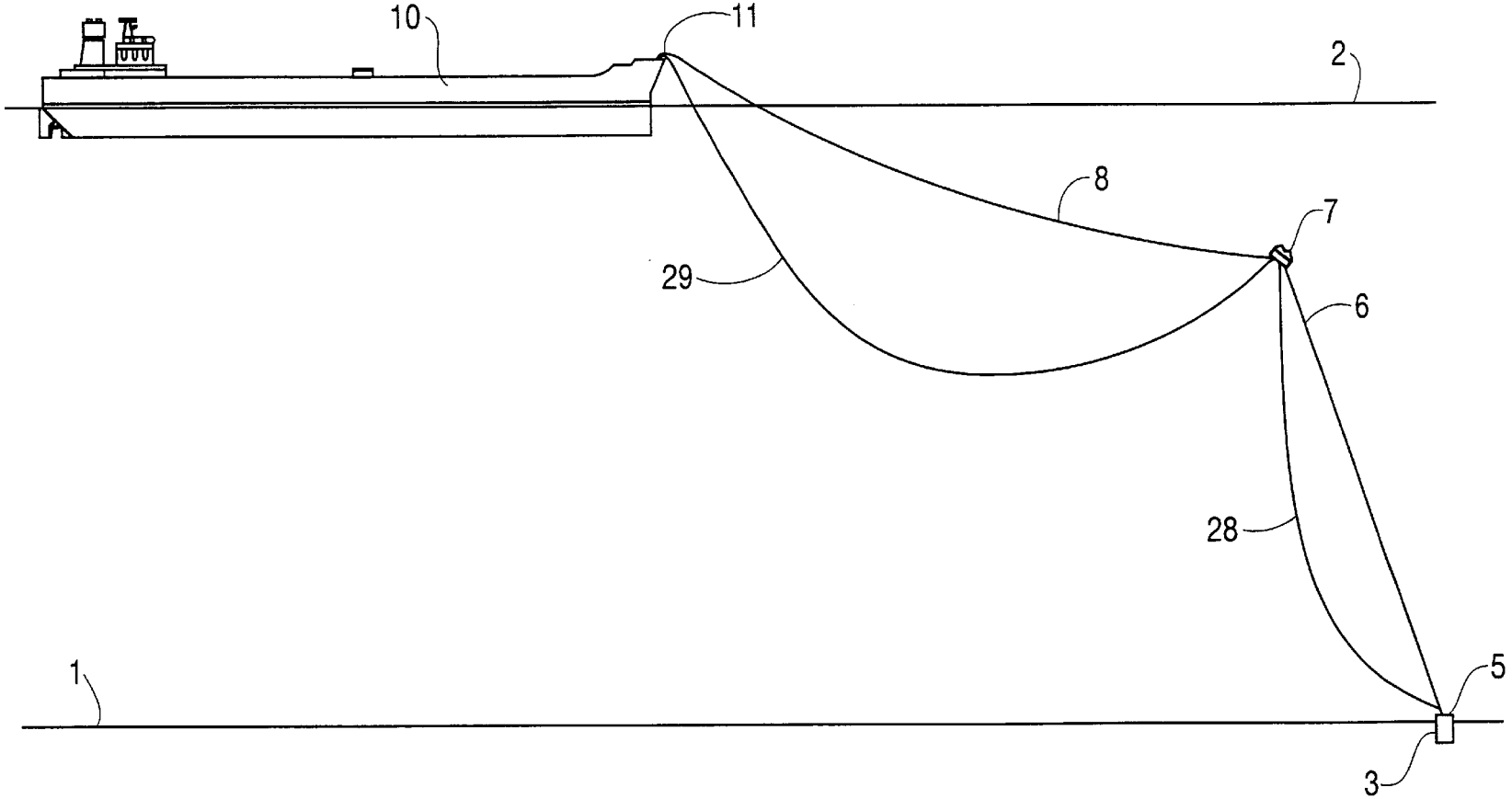
Figure 5:
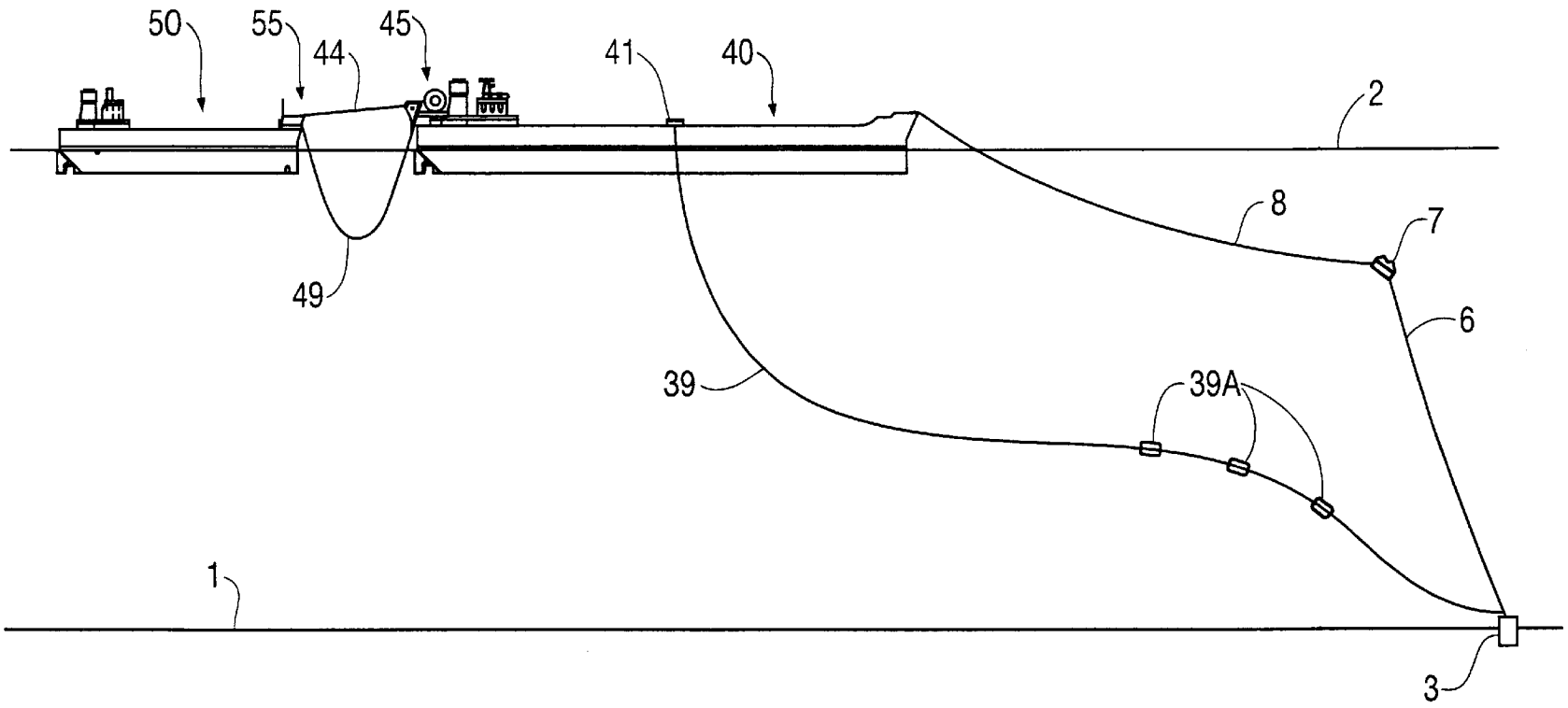
Figure 6:
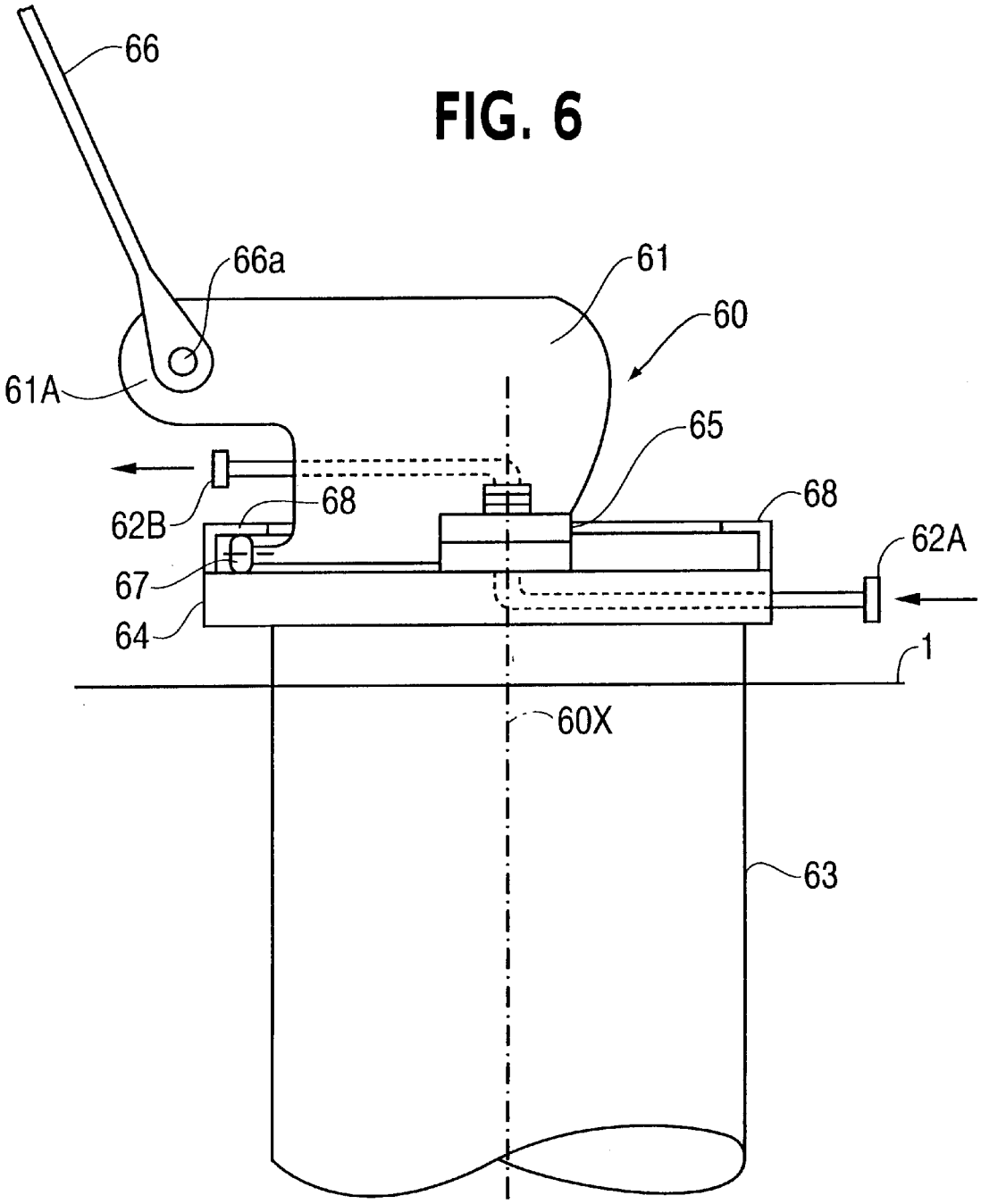
Figure 8:
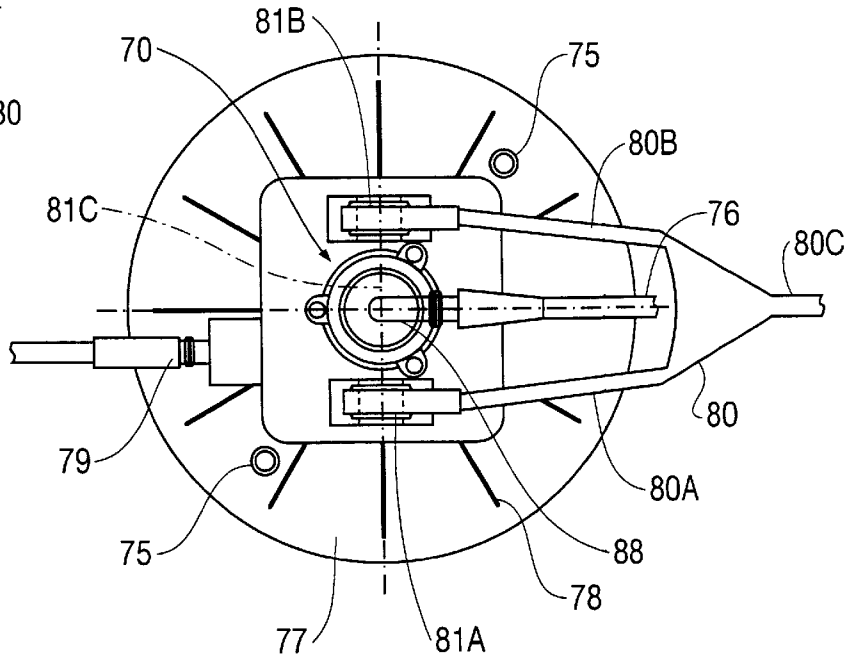
Figure 7:
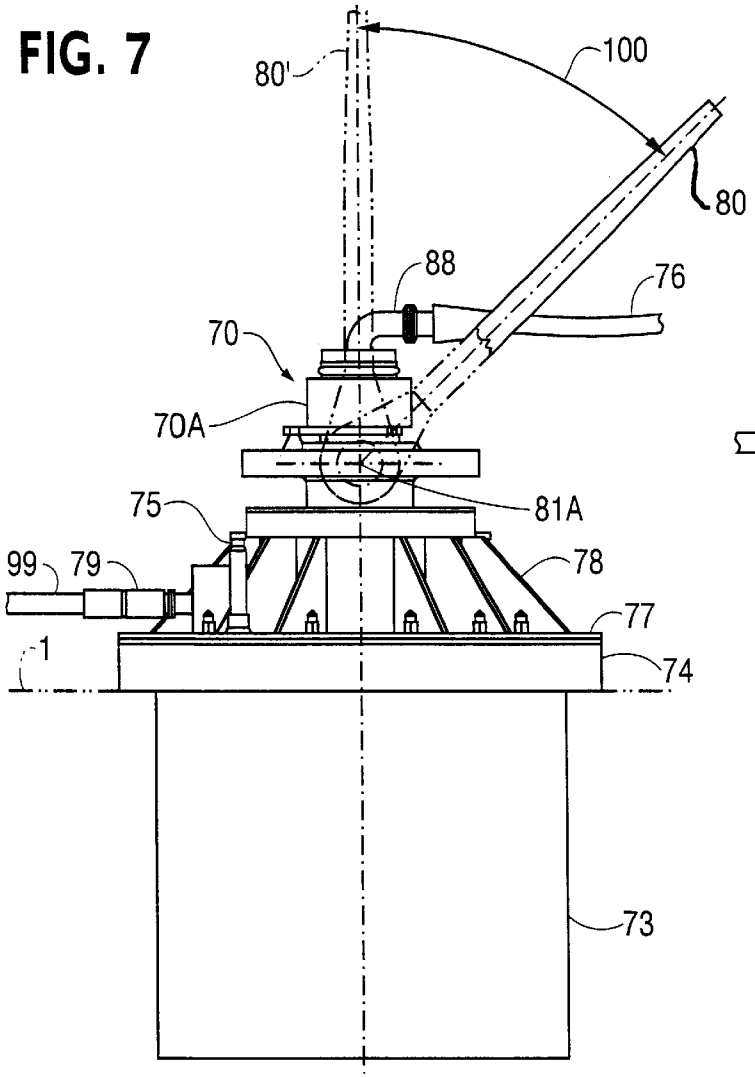
Figure 9:
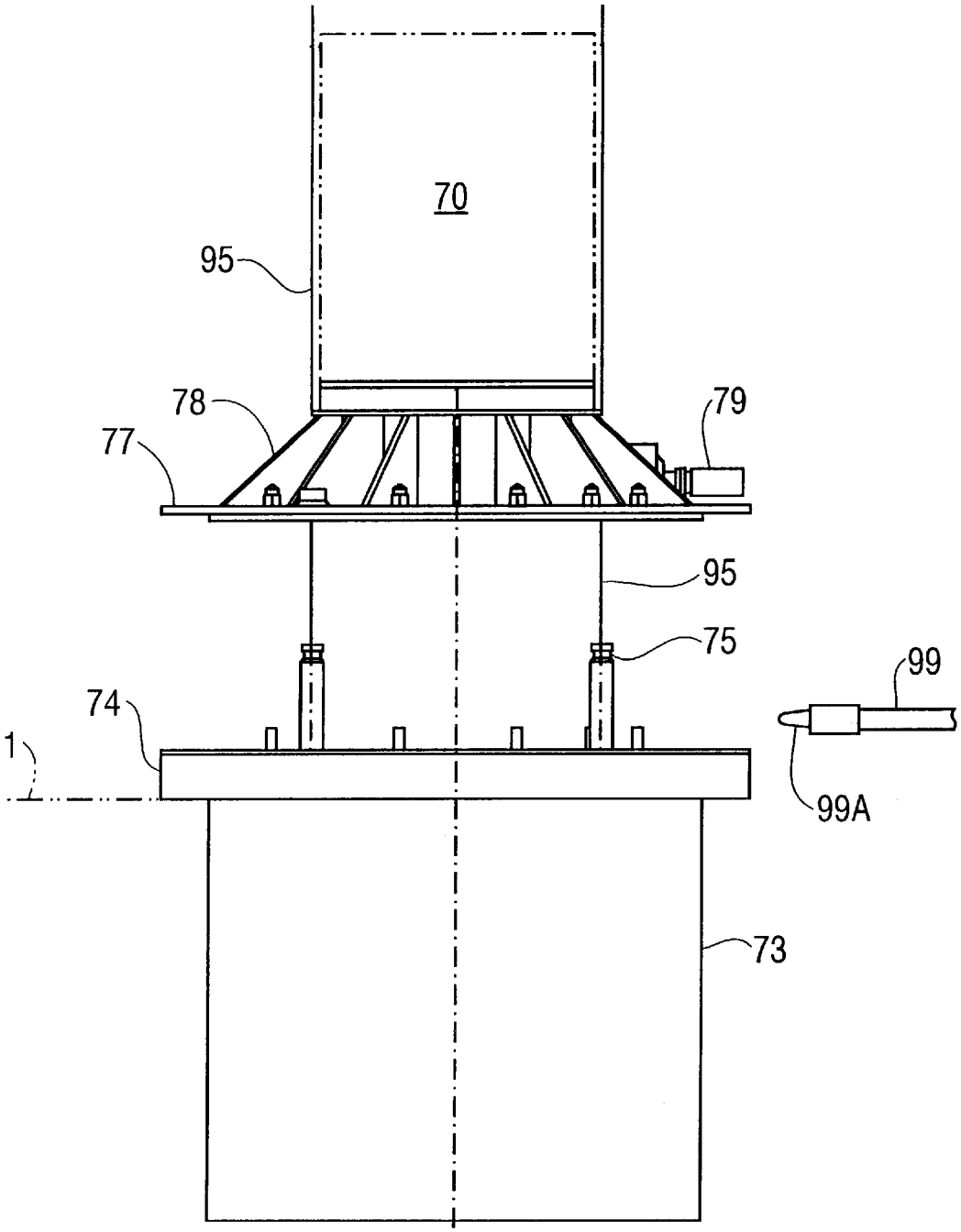

In the following description the invention will be explained more closely with reference to the drawings, in which:

FIG. 1 schematically shows a first embodiment of the system according to the invention, FIG. 2 more in detail and elevation shows an anchor with associated swivel means, which can be included in a system according to the invention, FIG. 3 shows the same as FIG. 2 in front elevation, FIG. 4 shows a variant of the embodiment of FIG. 1, FIG. 5 shows an arrangement mainly based upon the embodiment of FIG. 1, but with two ships in cooperation, FIG. 6 shows a second embodiment of the anchor means with associated swivel means in elevation and quite simplified, FIG. 7 in elevation shows a third and preferred embodiment of the anchor means according to the invention, FIG. 8 shows the embodiment in FIG. 7 seen from above, and FIG. 9 shows a situation where the anchor means in FIG. 7 is divided into two parts for retrieval of vital parts thereof to the surface.

In the drawings the seabed is indicated at 1 and the sea surface at 2. In FIGS. 1, 4 and 5 substantially corresponding or similar parts of the whole system according to the invention and the total arrangement involved in a mooring situation with associated operations. There is here in the first place the question of a ship 10, usually a tanker (40 in FIG. 5), an anchor 3 at the seabed 1 and an anchoring line with two parts 6 and 8 being at a middle portion provided with a buoyant body 7, also denoted line buoy. In the usual manner the ship 10 is equipped with mooring means 11 at the bow, without any details being shown more closely at this point.

The system according to the invention as described so far, is sufficient for the desired mooring of the ship 10, and in this connection involves advantages as already mentioned in the introduction above. An important feature of the mooring system is the line buoy 7, which is preferably located at or connected to a middle portion of the total anchoring line 6, 8. It is obvious that buoy 7 does not need to be exactly at the middle of the total line length, but in order that the desired effect be obtained, it is and advantage that the buoy is positioned at a good distance both from the lower end of anchoring line 6 at anchor means 3, and from the upper end of anchoring line 8 at mooring means 11.

The dimensions of buoy 7 are chosen so that under most conditions or stresses a quite significant angle difference between the adjacent portions of line parts 6 and 8 is established. Thus line part 6 will normally extend upwards from anchor 3 at a clearly smaller angle in relation to the vertical, than the angle at which line part 8 runs out from buoy 7. When the ship 10 is strongly affected by wind, waves or ocean currents, the whole anchoring line 6, 8 may be tightened more than shown e.g. in FIG. 1, so that buoy 7 is pulled deeper into the water and the angle between line parts 6 and 8 can approach more or less 180°. As an opposite extreme when a minimum of mooring forces are acting, buoy 7 may float to the sea surface 2, if the length of line part 6 is larger than the water depth.

The latter situation will be most likely to occur in the case of operations taking place near the cost or in more closed waters, such as at tanker terminals or the like. When operations and installations in more rough waters are concerned, e.g. far out at sea, buoy 7 as a rule will be located well immerged under the sea surface. This is per se a very favorable situation for the buoy and the whole system, since the buoy when located deep in the water is less subjected to influence from wind and waves occurring at the sea surface. It is also an important effect of buoy 7 that under substantially all conditions this will maintain anchoring line part 6 tensioned upwards from anchor 3, so that no part of the anchoring line will be lying on the seabed 1.

There may also be cases where this buoy device comprises more than one individual buoy, but still so arranged that there is provided a relatively limited deflection portion more or less at the middle of the total anchoring line. The main purpose of such a buoy or buoy device is to provide for a relatively concentrated buoyancy in the anchoring line, which results in a soft or flexible behavior of the whole mooring system, with reduced dynamic load effects.

The mooring system as such is subject of the simultaneously filed International patent application PCT/NO96/000203 (our ref. INT6165L).

In addition to the pure mooring function being explained above, this invention also comprises fluid transfer between the anchor means 3 and the ship 10. Thus in FIG. 1 there is shown a relatively flexible hose 9 being extended up to the bow portion of the ship 10, which is there provided with suitable connection means, that may very well be combined with the mooring means 11. Such means can be of designs being known per se. At a lower portion of hose 9 there are shown buoyant elements 9A, which in this case are provided in a number of three, but can of course vary in number and dimensions depending on the desired shape of hose 9. A primary purpose of buoyant elements 9A is to secure that the lower portion of hose 9 is generally always elevated from seabed 1. It is a great advantage that hose 9 runs through the water well underneath anchoring line 6, 8, as illustrated in FIG. 1. Thereby any contact between the two main parts of the system is avoided, in particular so that hose 9 will not be damaged by any part of anchoring line 6, 8.

FIGS. 2 and 3 in more detail show a possible and preferred design of the anchor 3 with associated equipment, in particular a swivel device 5 at the top of anchor 3. According to the invention this preferably has the form of a suction anchor, which can be of a design as known per se, and adapted to penetrate into loose masses underneath the actual seabed 1 in order to obtain a strong anchoring effect. In the example shown in FIGS. 2 and 3 the suction anchor 3 thus has a downwardly open cylindrical shape.

Centrally on top of anchor 3 there is shown a fixed carrier member 13 which supports the actual swivel device 5. This has an upper connection member 19 with a pipe bend to which the lower end of hose 9 is connected, e.g. by a flange connection. The lower swivel part 18 serves for the attachment of two line parts 6A and 6B as shown more in detail in FIG. 3. Line parts or portions 6A and 6B constitute the lower end of a so-called crowfoot having an apex at 6C (FIG. 1) so that the crowfoot as a whole has the shape of a preferably isosceles triangle the base line of which is formed by an arm structure 15A, 15B. This is cantilevered to each side from the lower swivel member 18 and is adapted to be rotated together with the swivel part about the central axis of the complete anchor and swivel means. Arms 15A and 15B have a common horizontal axis 15C and line portions 6A and 6B respectively, are connected to the outer ends of arms 15A and 15B so as to be pivotable about the axis 15C. An important purpose of arms 15A and 15B is to provide for a sufficient torque for the swivel movement about the central, vertical axis, depending upon the direction of the mooring force from the ship 10 through the anchoring line 6, 8. Swivel members 18 and 19 are united with respect to rotation.

In the arrangment described above in addition to rotation about a vertical axis, there is the possibility also of pivoting or articulation about a horizontal axis, namely axis 15C. Instead of a more or less flexible crowfoot as mentioned, there can also be provided a more rigid, yoke-like design being incorporated in the anchor means as a whole. Both in the case of a crowfoot and in the case of a rigid yoke conventional attachment means or methods can be employed for the lower ends of the anchoring lines. Here there may also be the question of a relatively permanent attachment or a connection that can be relatively easily loosened, that can e.g. be manipulated by means of an ROV. Such a possibility of detachable fastening comprises a device of the type "chain stopper", which can be self-locking and otherwise can allow for manipulation or operation as known per se.

As seen in particular from FIG. 2 hose 9 has a direction outwards and upwards from swivel means 5 at a smaller angle in relation to the horizontal than anchoring line portion 6A. When hose 9 as shown in FIG. 3, runs out centrally between line portions 6A and 6B, there is minimal risk of damage to hose 9 by contact with any portion of the anchoring line.

Particularly in view of the large forces that can occur and the resulting stresses in the structure, it is an advantage according to the invention that the attachment means for anchoring lines at the end of arms 15A and 15B are located at a lower level than connection member 19 for hose 9 when this is all installed at the seabed 1. The structure also comprises the ability to allow more vital parts of the anchor means can be retrieved to the surface for maintenance, repair or replacement. At 20 in FIG. 2 there is indicated a separation or plane showing how the actual suction anchor 3 can be separated from the remaining parts, i.e. the carrier member and the swivel means, whereby the carrier member e.g. by detachable bolt connections can be attached to the top of suction anchor 3. Before these retrievable parts are hoisted up, also the connection of pipeline 14 must be loosened and possibly plugged.

As a possible, but not preferred alternative, there is indicated at 9X a direction of the hose directly upwards centrally from swivel means 5, which implies that such a hose somewhere higher up in the water will have to cross or pass by the anchoring line 6, 8. This is usually a less favorable solution. Finally FIG. 2 shows a pipeline 14 connected for supplying e.g. produced fluid, such as hydrocarbons, to the anchor installation 3, namely the stationary carrier member 13 thereof for the swivel means 5.

FIG. 4 shows a modification of the arrangement in FIG. 1, where the transfer hose 28, 29 in FIG. 4 has not been provided with its own buoyant element, but is suspended from line buoy 7. As a result of hose parts 28 and 29 being of larger length then corresponding parts of anchoring lines 6 and 8, respectively, the hose will generally run through the water at a good distance underneath the anchoring line. In this embodiment buoy 7 apparently must be dimensioned to have somewhat more buoyancy than in the embodiment of FIG. 1. Compared to FIG. 1 the system of FIG. 4 could be considered to act as a more integral, unitary system, which may be better maintained under control when the ship 10 moves around the anchoring point during varying weather conditions. This can be advantageous e.g. in view of varying currents at smaller or larger water depth.

When suspending hose 28, 29 in buoy 7 as mentioned above, it can be an advantage to provide a supporting bend or the like for guiding the suspension portion of the hose with a certain radius of curvature that is not too small, so that the hose at this portion will not have undue bending or tensional stresses. A further possibility at this point is that suspension from the buoy can take place through a more or less resilient element, so that hose 28, 29 is only subjected to relatively soft or damped movements in relation to buoy 7.

To a substantial degree the arrangement of FIG. 5 is based on a system according to the invention being in the principle like the embodiment of FIG. 1, but in FIG. 5 the hose 39 with associated buoyancy elements 39A at the lower portion, is connected to equipment 41 mid-ship of ship 40 with the upper end of the hose. Equipment 41 can be connection devices being per se of conventional type, such as a so called manifold.

Specific to the arrangement of operation being illustrated in FIG. 5, is that tanker 40, which can have a large capacity, is adapted to cooperate with e.g. a tanker or a barge 50, whereby a fluid load can be transferred through a hose connection 49 from the aft end of ship 40 to the bow of ship 50, at the same time as a mooring 44 is extended between both ships. Equipment units as shown at 45 and 55, respectively, on the ships, can be of conventional design as known per se, for the hose connection 49 and the mooring 44, respectively.

In the embodiment of the anchor means shown in a simplified way in FIG. 6, there is involved a suction anchor 63 as in FIGS. 2 and 3, but here again there can be a possibility of letting the actual anchor part be based on other types of anchoring principles, e.g. gravitation or piling as mentioned before. At the top of the actual anchor part 63 there is shown a frame or plate 64 for supporting swivel means 60. This has a rotation axis 60X being preferably also a center line of suction anchor 63. The actual fluid swivel 65 in this case is located just above plate 64 and serves to provide fluid connection through a connector 62A for a pipeline extending at the seabed 1 from an underwater installation not being shown. Through plate 64 and fluid swivel 65 the fluid connection is led through a force carrying anchoring member 61 which constitutes an upper part of swivel means 60. Thus, at 62B there is shown a connection flange or the like for a flexible hose adapted to be extended to the surface, as e.g. hose 9 in FIG. 1.

A projection 61A from anchoring member 61 is provided with one or more attachment elements 66A for an anchoring line 66 or a yoke or the like to which the anchoring line is attached. In the case of a yoke or a crowfoot as the lowermost prolongation of the anchoring line, there can be provided a device associated with attachment elements 66A for equalizing the forces in both legs comprised by the yoke or the crowfoot.

Moreover in consideration of the large forces that can occur, there is provided one or more supporting rollers 67 at the lower portion of member 61 corresponding angularly to projection 61A. These supporting rollers are adapted to roll at the upper side of plate 64. A guide ring 68 which can have an angle profile, is mounted radially outwards of and axially above the supporting roller 67 for protecting and securing this. With such provision of supporting roller(s) the central journalling of anchoring member 61 and the actual fluid swivel 65 to a high degree will be relieved of the large anchoring forces that can occur, since the radial distance of the supporting roller from the rotation axis 60X is relatively significant. In most mooring situations the mooring force in anchoring line 66 will have such a direction that supporting roller(s) 67 will be urged upwards against guide ring 68. Accordingly, this must have corresponding dimensions.

FIGS. 7 and 8 show a preferred embodiment of anchor means according to the invention. As in the embodiment of FIG. 6 there is shown in FIG. 7 an anchor member 73 in the form of a suction anchor which on top is provided with a strong frame or plate 74. Above this there is shown a base part 77 which can be plate shaped and supports a carrier member or structure 78 on which the actual swivel device 70 is mounted. Moreover, base part 77 supports at least one connector 79 for the connection of a pipeline 99 from an installation (not shown) at the seabed 1. As will be seen more particularly from FIG. 9 one or more guide posts 75 are provided on top plate 74 for cooperation with elements on base part 77, during retrieval and returning of the structures and components being carried by base part 77, by means of a surface vessel.

A central component in swivel device 70 in FIG. 7 is a swivel housing 70A in which the rotatable fluid connection is arranged, e.g. in a manner known per se. Thus, fluid communication can be established between pipeline 99, which is stationary, and a flexible hose 76 adapted to be connected to a vessel at the surface, for loading or unloading of hydrocarbons. At the top of swivel device 70 there is shown a connector member 88 for hose 76. Lower down there are shown attachment elements 81A and 81B at either side of the swivel device, with a pivotable mounting of two legs 80A and 80B being incorporating in a yoke 80. As shown in FIG. 8 this has a common apex 80C with means for cooperating with the lower end of an anchoring line (not shown).

When by means of the anchoring line the surface vessel mentioned, is moored with the anchor device as shown in FIGS. 7 and 8, with a simultaneous hose connection 76 for fluid transfer, the weathering movements of the ship under the influence of wind, waves and current, will involve angular movement or rotation of the whole swivel device about the vertical axis shown, whereby hose 76 preferably all the way through the water up to the surface runs lower than the anchoring line and more or less in the same vertical plane as this. Adjacent to swivel device 70 it is obvious that hose 76 with connector 88 is located centrally underneath yoke 80, so that this will not contact the hose or its connection at the top of swivel device 70.

In the lower region i.e. in the region at the level of or lower than attachment elements 81A, 81B, there is provided for strong journalling of the whole structure, including the swivel housing 70A, and this journal arrangement is adapted to take up the forces and bending moments being due to a connected fluid hose 76 and the anchoring line as the case may be.

As illustrated in FIG. 7 the yoke 80 can also be swung up and down about a horizontal axis 81C (FIG. 8) between attachment elements 81A and 81B, which can comprise horizontal axle studs coinciding with axis 81C. At 100 in FIG. 7 there is shown a possible angular range within which yoke 80 can move, with one angular position 80' directed vertically upwards. This position of yoke 80 is of interest, inter alia, when retrieving and lowering the above mentioned vital parts of the anchor device, as will be explained below with reference to FIG. 9.

The system described here can e.g. be intended for operation at water depths from 150–300 meters. At a depth of e.g. 200 meters the two parts 6 and 8 of the total anchoring line can typically be 160 meters and 200 meters respectively, in a favorable practical embodiment.

Otherwise it is obvious that various modifications and variants can be contemplated within the framework of the invention. Thus when it is stated that anchor 3 is permanent, this does not mean e.g. that a suction anchor or a gravitation anchor must remain forever at the seabed 1, upon being installed. As known even such relatively fixed installations at the seabed can be removed by suitable means and equipment. A permanent anchor device in this context means a more permanent anchor than what is typically carried by a ship and can be thrown from this or hauled into the ship by means of its normal anchor capstan.

A method of installation of an anchor device in the system as explained above, according to the invention with advantage can consist in that the anchor is suspended at the end of an anchor chain or wire belonging to a generally regular anchor capstan or winch of the ship concerned, being employed for lowering the anchor to a predetermined point at the seabed.

For illustrating the separation of the main parts of the anchor device as mentioned above, the preferred embodiment according to FIGS. 7 and 8 is taken as a background for FIG. 9. In the latter the suction anchor 73 with top plate 74, base part 77 with carrier member 78 are found, and the actual swivel device 70 has only been indicated schematically. Besides the connector 79 is shown after disconnection of pipeline 99 with associated connector part 99A. From guide posts 75, guide lines 95 are extended up to the surface vessel concerned, for guiding base part 77 with all components carried thereby, up to the surface, and conversely for lowering these parts of the structure upon a possible repair or the like, for renewed installation on anchor member 73 with top plate 74. The operations involved in this connection can be more or less conventional, but a specific method is explained above, namely by employing the regular anchor capstan of the ship concerned as well as an anchor chain or wire.

Simultaneously with the lowering of the anchor device as mentioned, the hose or riser 9 can be paid out from an assisting auxiliary vessel.

In FIG. 1 there is illustrated an apex 6C of the crowfoot as also explained with reference to FIGS. 2 and 3, but it is obvious that the position of apex 6C can vary considerably, and possibly the apex can be adjacent to or on the buoyant body or buoy 7. In the case of an approximate vertical direction of the hose (as shown at 9X) from swivel means 5 in FIG. 2, it can be expedient to let the hose cross or pass by the anchoring line 6 between the two portions 6A and 6B thereof in the crowfoot, at a portion higher up in the water. It is also possible to let this crossing take place adjacent to the buoy 7 when the apex 6C is correspondingly located, whereby the hose in such case can also be suspended from the buoy at this location.

What is claimed is:

1. System for loading or unloading ships at sea, in particular for operations in connection with oil and gas activity, whereby the ship concerned is equipped with a mooring device, and where there is included an anchor located at the seabed and being in fluid communication with a subsea installation, as well as at least one anchoring line adapted to connect said anchor to said mooring device on the ship, comprising:

a permanent anchor device as said anchor, said permanent anchor device being provided with a swivel device for said anchoring line, wherein a lower portion of said anchoring line is designed with a crowfoot connected to said swivel device, a buoyant body attached to a middle portion of the anchoring line, and a hose the lower end of which is connected to said swivel device and the upper end of which is adapted to be connected to a fluid connection unit on said ship.

2. System according to claim 1, wherein the said permanent anchor device is chosen from the group consisting of a suction anchor, a gravitation anchor, and a pile anchor.

3. System according to claim 1, wherein said swivel device comprises two cantilevered arms having outer ends to which the lines of said crowfoot are attached.

4. System according to claim 1, wherein said hose is provided with buoyancy elements.

5. System according to claim 1, wherein the hose is separated into more than one hose at least one of which is connected to said buoyant body, at least one of which is connected to said anchor, and at least one of which is connected to said mooring device.

6. System according to claim 2, wherein the lower end of said hose is connected centrally at said swivel device.

7. System according to claim 6, wherein said hose during substantially all anchoring conditions extends from said swivel device at a more horizontal angular position than the angular position of the lower portion of said anchoring line.

8. System according to claim 1, wherein said hose as a result of its length and exerted buoyancy is adapted to extend through the water underneath said anchoring line.

9. System according to claim 3, wherein the crowfoot is pivotable about an axis between the cantilevered arms.

10. System according to claim 6, wherein the said hose extends from swivel device centrally between the crowfoot lines.

11. An anchor for installation at the seabed for mooring, loading or unloading of ships or other vessels, in connection with oil and gas activity at sea, comprising a swivel device provided with attachment members for at least one anchoring line from the ship, whereby a rotation axis of said swivel device is adapted to be approximately vertical at the seabed thereby allowing the swivel device to rotate in a plane approximately parallel to the seabed, and whereby said swivel device comprises a swivel member for a fluid hose and a through-going fluid passage adapted to be connected to an installation at the seabed, and wherein said attachment members comprise two cantilevered arms having outer ends for attachment of anchoring lines; wherein a lower anchor part on one hand and substantially all other parts on the other hand, including said swivel device are separable by means of detachable joining elements, so that the other parts can be retrieved to the surface for maintenance, repair or replacement.

12. Anchor according to claim 9, wherein said attachment members are adapted to be located at a lower level than said swivel member in operative position at the seabed.

13. Anchor according to claim 11, comprising a force transferring main member having a radial projection which carries said attachment members, and at least one supporting roller connected to said main member and located essentially underneath said projection and being adapted to roll in a guide at the top of a lower anchor member.

14. Anchor according to claim 11, comprising a plate or frame like base member resting on top of the actual anchor member and separable therefrom, that said base member is provided with a carrier member for said swivel device, and that said base member carries a connector for a pipeline from an installation at the seabed.

15. Anchor according to claim 14, wherein said connector is adapted to make possible connection and disconnection of said pipeline.

16. Anchor according to claim 14, comprising an outer swivel housing which is arranged to be rotatable in relation to said anchor member and which carries said connection member, and a journal device for said swivel housing which is adapted to transfer bending forces being due to a connected fluid hose and possibly an anchoring line to said anchor member, through said carrier member and base member.

17. Anchor according to claim 11, comprising a yoke having two legs the outer ends of which are pivotably connected to said attachment members being located at either side of said swivel device, and that the opposite end of said legs are adapted to be connected to an anchoring line.

18. Anchor according to claim 11, wherein the said anchor is chosen from the group consisting of a suction anchor, gravitation anchor, and a pile anchor.

19. Method for installation of an anchor characterized by swivel device provided with attachment members for at least one anchoring line from the ship, whereby a rotation axis of said swivel device is adapted to be approximately vertical at the seabed, and whereby said swivel device comprises a swivel member for a fluid hose and a through-going fluid passage adapted to be connected to an installation at the seabed in a system according to claim 1, wherein said anchor is suspended at the end of an anchor chain or wire belonging to a generally regular anchor capstan or winch of the ship concerned, being employed for lowering the anchor to a predetermined point at the seabed.

* * * * *